United States Patent [19]

Stanley

[11] 4,162,564

[45] Jul. 31, 1979

[54] METHOD AND APPARATUS FOR STUFFER CRIMPING STRAND MATERIAL

[76] Inventor: Robert K. Stanley, 620 Meadowvale La., Media, Pa. 19063

[21] Appl. No.: 809,992

[22] Filed: Jun. 27, 1977

[51] Int. Cl.[2] ..... D02G 1/12; D02G 1/20

[52] U.S. Cl. ..... 28/248; 28/250; 28/251; 28/255

[58] Field of Search ..... 28/248, 249, 250, 251, 28/255, 256; 34/51, 52; 139/452

[56] References Cited

U.S. PATENT DOCUMENTS

| | | | |
|---|---|---|---|
| 3,166,821 | 1/1965 | Furlong | 28/251 |
| 3,280,444 | 10/1966 | Stanley | 28/251 |
| 3,763,669 | 10/1973 | Bous et al. | 34/52 X |
| 3,777,338 | 12/1973 | Vermeer et al. | 28/250 |
| 3,911,539 | 10/1975 | Hughes et al. | 34/51 X |
| 3,961,401 | 6/1976 | Ferrier et al. | 28/249 |
| 3,977,058 | 8/1976 | Borenstein et al. | 28/249 |
| 4,007,518 | 2/1977 | Larson | 28/249 |
| 4,012,816 | 3/1977 | Hatcher | 28/249 |

FOREIGN PATENT DOCUMENTS

| | | | |
|---|---|---|---|
| 1161674 | 8/1969 | United Kingdom | 28/250 |

*Primary Examiner*—Robert Mackey
*Attorney, Agent, or Firm*—Charles A. McClure

[57] ABSTRACT

Textile strands are bulked or crimped by lengthwise compression, accompanied by flow of propellant fluid, into a foraminous region in which the strand is confined laterally but the fluid may escape except where the strand is compressed into a compact mass. Lateral escape of the propellant fluid is utilized to control an operating condition, such as temperature of strand input into and/or speed of removal of strand from the chamber, for improved uniformity of bulking or crimping.

7 Claims, 9 Drawing Figures

METHOD AND APPARATUS FOR STUFFER CRIMPING STRAND MATERIAL

This invention relates to bulking or crimping of funicular textile material, usually called herein textile strands or simply strand(s), and concerns particularly such strand treatment to improve uniformity of bulking or crimping, especially at high processing speeds.

With increasing operating speed, processes of intentional distortion of textile strands, as to impart bulk or crimp thereto, become subject to temperature limitations. A resulting tendency to soften, fuse, or degrade is aggravated in thermoplastic strand compositions by a correlative reduction in time available for heat transfer to, from, or within the strand at rapid transport rates.

Many methods of intentional distortion, especially of the axial configuration, of textile strands have been devised, especially for those of thermoplastic composition, such as nylon, polyester, polyalkylene, and the like. Most of such methods were intended to bulk or crimp the strand to give it more visible "cover" or more desirable "handle" than was present in the strand material as produced. Additionally, such methods were developed or modified so as to increase processing conditions, such as speed or throughput, and to improve product characteristics, such as uniformity in the degree of resulting crimp or dispersion in crimp orientation, etc.

Longitudinally compressive crimping is one of the most successful methods of treating textile strands to accomplish such purposes. Roll feeding of strands into laterally confining chambers for such crimping is conductive to localized overheating of the uncrimped strand and consequent non-uniformity of the crimped strand. Fluid-jet feeding is hampered by low heat transfer rates and by increasingly difficult control of back pressure or compressive impedance of the strand with fluid propulsion at high speeds.

A primary object of the present invention is improved jet-stuffer-crimping of funicular textile material or textile strands.

Another object of this invention is high-speed bulking or crimping of textile strands by the longitudinally compressive method.

A further object of the invention is control of such strand processing to render it self-regulating.

Still another object of this invention is provision of substantially uniform impedance to longitudinal transport of strand material being compressively crimped.

Yet a further object of the invention is production of dephased crimp orientation in compressively or stuffer crimped textile strands.

Other objects of the present invention, together with means and methods for attaining the various objects, will be apparent from the following description and the accompanying diagrams of the invention, which are presented by way of example rather than limitation.

In general, the objects of the present invention are accomplished, in compressive crimping of funicular textile material propelled lengthwise and accompanied by flow of propellant fluid into a first laterally confining region wherein propelled textile material accumulates temporarily as a compressed mass in a downstream portion of the region, and at least some such fluid diffuses laterally from a portion of the region unoccupied by the compressed mass, by utilizing lateral diffusion of such fluid to control the accumulation of compressed textile material in the region.

Thus, in apparatus for such crimping, the invention comprises means for sensing such lateral diffusion, mounted adjacent the confining region, and control means responsive and operatively connected thereto for controlling a physical condition to which the textile material is subjected in the process. Such means comprises speed-control means for temperature control means, for example.

Figure 1:
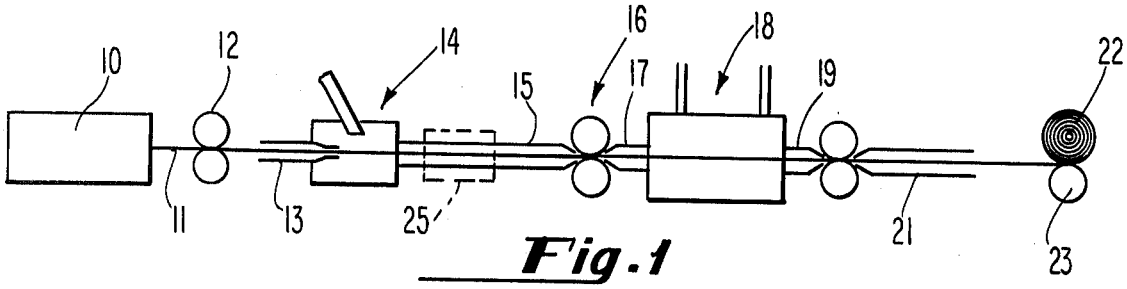
FIG. 1 is a simplified schematic diagram of the treatment of textile strand material according to this invention.

FIG. 1 shows in simplified schematic form, textile strand 11 supplied from source 10. The source may comprise an extruder of a fiber-forming composition into a multiplicity of filaments subsequently gathered into a bundle or strand, drawn to permanently increased length, and withdrawn from godets or other roll arrangements or other forwarding means. Alternatively, the source may comprise a package of previously extruded but undrawn multifilament strand plus a suitable drawing system, or may comprise a package of drawn multifilament strand. Pair of nip rolls 12 withdraw the strand from the source and control its rate of entry into and travel through inlet tube 13 and jet means 14 and into laterally confining stuffing chamber means 15—part of which, including that portion surrounded by sensing means 25 (shown in broken lines), is foraminous. The openings (not visible here) in the foraminous part of chamber means 15 are large enough to permit ready escape of the fluid used as a propellant in the jet but small enough to preclude admitting or abrading a filament of the strand. From the stuffing chamber, the strand in compressed form (not shown as such) is withdrawn by pair of nip rolls 16 and is fed thereby via entrance fitting 17 into a succeeding treating chamber (not visible), part of which may be formaminous and/or jacketed to permit introduction of treating fluid thereinto, either into contact with the strand or into non-contact heat-exchanging relationship therewith via the intervening wall. Fluid transport means 18 surrounds the treating chamber and provides an entry (and exit, if necessary) for such treating fluid. Pair of nip rolls 20 forward the treated compressed strand from exit fitting 19 immediately downstream of the treating chamber into outlet chamber 21 from which it is wound up (or, alternatively, forwarded further) lengthwise in strand form as onto package 22 driven by roll 23, which may be of self-traversing type.

Figure 2:
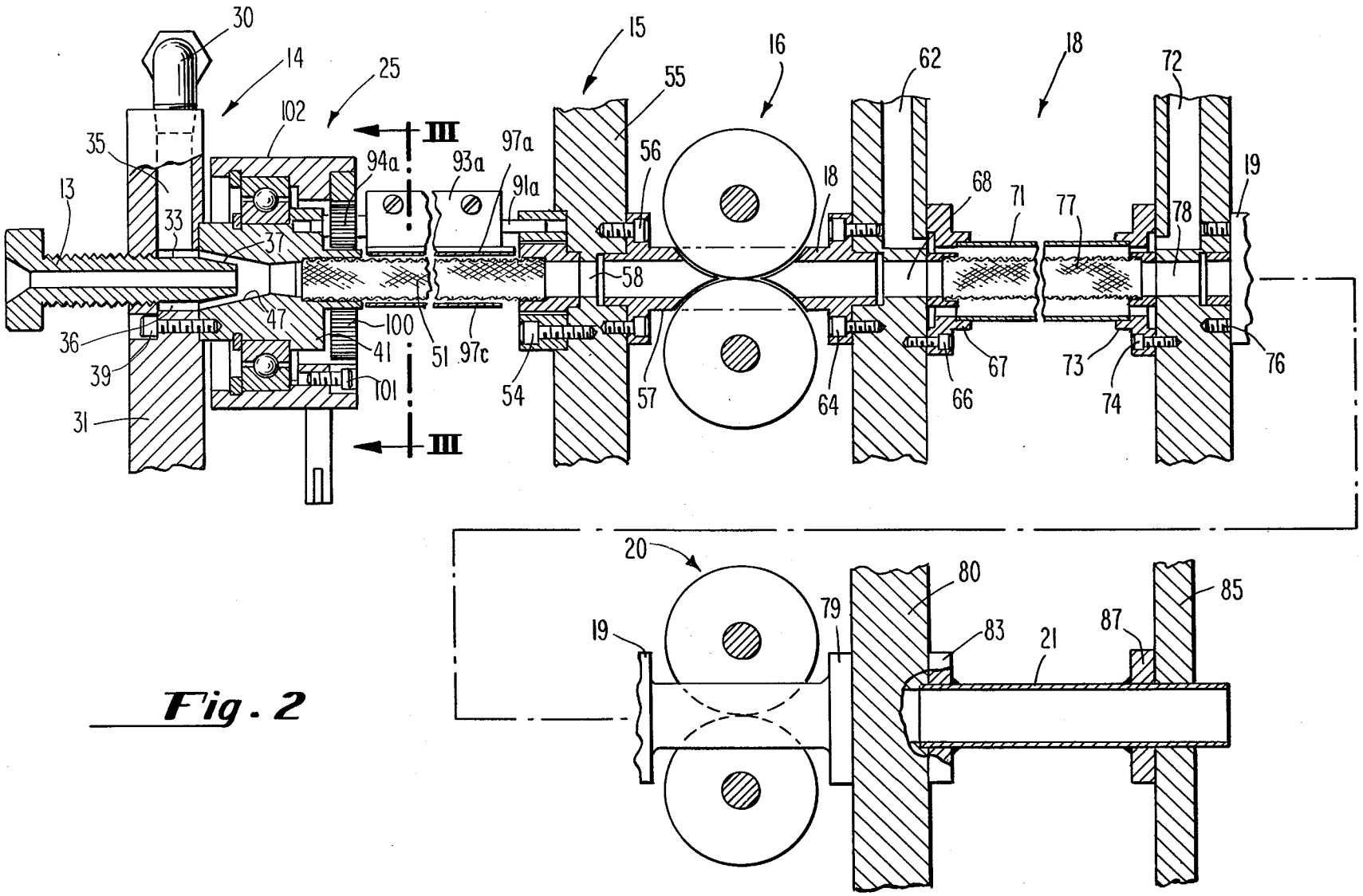
FIG. 2 is a side sectional elevation of apparatus for so treating textile strands.

FIG. 2 shows in longitudinal section and considerably greater detail (and appropriate modification), apparatus shown schematically in the preceding view, excluding the source and windup means and with strand 11 omitted in the interest of clarity. Inlet tube 13 is shown threaded into first support plate 31, which is hollowed out by vertical bore 35 and adjoining annular space 36 around cylindrical end portion 33 of the tube. The support plate forms part of jet means 14 together with fluid tube 30, which discharges into vertical bore 35. Tapered downstream or exit end 37 of the inlet tube for the strand is located within similarly tapered frustoconical inlet portion 47 of jet housing 41 secured (as by screws 39, one shown) to the first support plate. The upstream or strand inlet end of foraminous inlet tube 51 of stuffing chamber means 15 fits into the jet housing, which tapers outwardly to receive complementarily tapered exit end 37 of the strand inlet tube. The other or downstream end of this foraminous tube fits into first annular stuffing chamber support piece 53 secured (as by screws 54, one shown) to support plate 55 of stuffing chamber means 15. Second annular stuffing chamber support piece 57, which forms a solid-walled downstream portion of the chamber itself, is similarly secured to second support plate 55 (as by screws 56, two shown) opposite first support piece 53 and axially aligned therewith but with their adjacent ends spaced apart by intervening hollow 58 in the plate. The tapered downstream end of stuffing chamber support piece 57 fits into the upstream nip or bight of withdrawal roll pair 16 (enclosed laterally as indicated in broken lines).

Fitting similarly into the downstream nip of withdrawal roll pair is the tapered upstream end of treating chamber entrance fitting 17, whose flanged opposite or downstream end is secured (as by screws 64, two visible) to third support plate 65. Second annular treating chamber support piece 67 is secured (as by screws 66, one shown) to the downstream side of support plate 65 and receives the upstream end of foraminous part 77 of the treating chamber as well as the upstream end of surrounding jacket 71. The downstream ends of the respective tubular members are retained in third annular support piece 73 secured (as by screws 74, one shown) to fourth support plate 75 for the treating chamber. Treating chamber exit fitting 19 is secured similarly at its flanged upstream end to support plate 75, with its tapered downstream end fitting into the upstream nip of forwarding roll pair 20. Fitting similarly into the downstream nip of the same pair of rolls is tapered upstream end of outlet tube entrance fitting 79, whose flanged downstream end is secured to fifth support plate 80. Annular outlet first support piece 83 is secured to the downstream side of fifth support plate 80 and receives the upstream end of outlet tube 21, whose downstream end is secured similarly by annular outlet second support piece 87 to sixth support plate 85, through which the outlet tube passes and then terminates in open downstream end 89.

Figure 3:
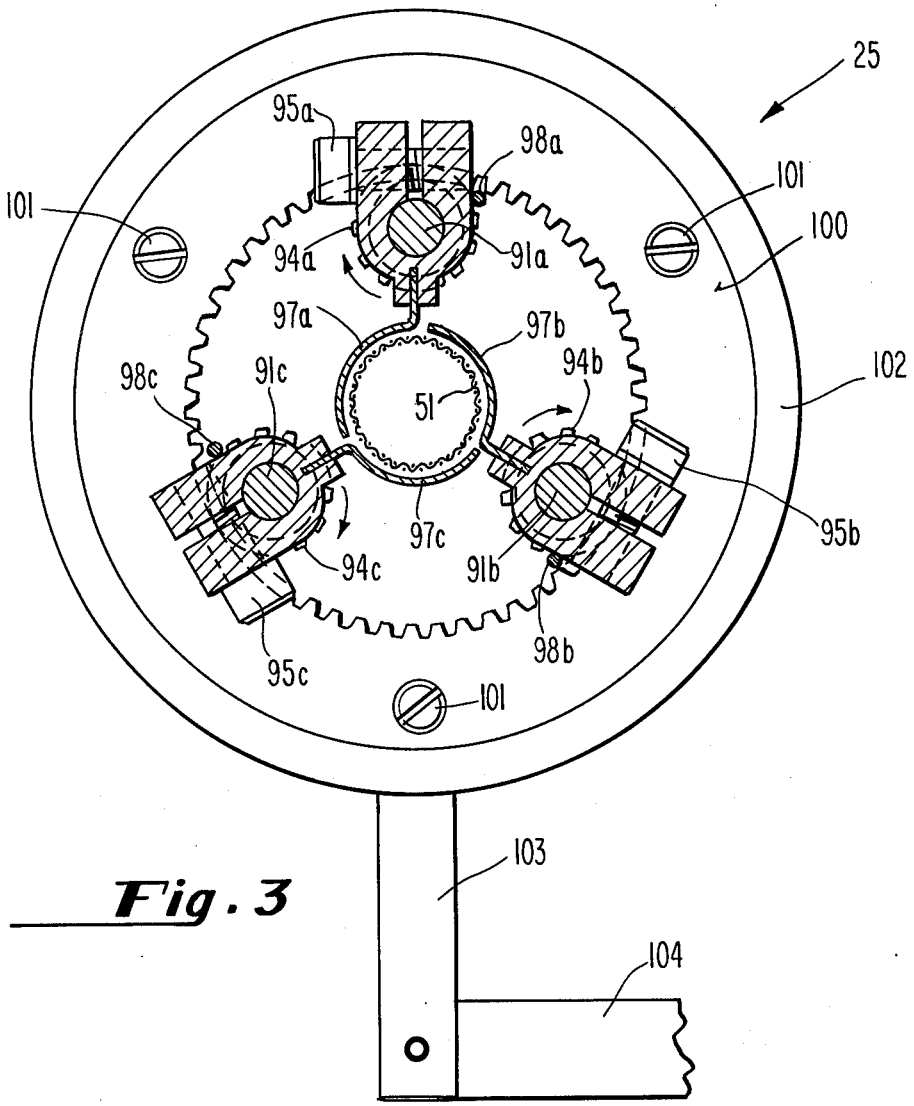
FIG. 3 is a transverse sectional elevation of part of such apparatus, taken at III—III on FIG. 2.
Figure 4:
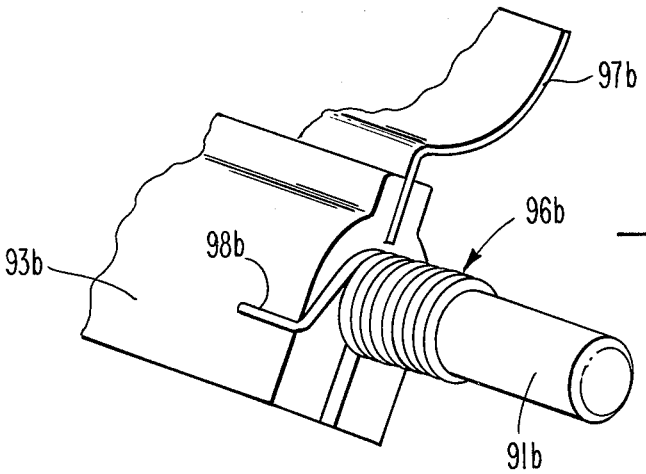
FIG. 4 is a perspective view of part of the apparatus of FIG. 3.

Located between the first and second support plates and generally surrounding the foraminous portion of the stuffing chamber is sensing means 25, indicated schematically in broken lines in FIG. 2 but shown enlarged and in detail in FIGS. 3 and 4. Three axles **91*a*, 91*b*, 91*c* are journaled at the left end in housing 41 of jet means 14 and at the right end of second support plate 55, equidistant in radius and arc about the axis of foraminous inlet tube 51 of stuffing chamber 15. Clamped to the respective axles are U-shaped holders 93*a*, 93*b*, 93*c* with bolts 95*a*, 95*b*, 95*c* holding their respective pairs of arms together about the intervening axles. Vane 97*a* is secured in a slot in the bight of U-shaped holder 93*a* oriented toward the chamber axis with the body of the vane curved arcuately about and in close proximity to the foraminous inlet tube for the strand, as shown most clearly in FIG. 3. Vanes 97*b* and 97*c* are supported similarly by the other holders and are positioned similarly, each holder being spring-biased into such closed position as shown most clearly in FIG. 4. The holder 93*b* for vane 97*b* has biasing spring 96*b* wrapped around axle 91*b* with end 98*b* of the spring contiguous with the near side of the holder (and the other end, not visible, secured to the axle, as by terminating in a radial bore therein or by a screw, etc.). Each holder may rotate clockwise from the closed position through a limited arc as suggested by the arrows juxtaposed thereto in FIG. 3 and the double-headed arrow for the partly rotated holder in FIG. 4**.

Further details of the sensing means appear in FIG. 2, where only holder **93*a* is shown. The left end of axle 91*a* has pinion gear 94*a* affixed thereon in engagement with ring gear 100, which surrounds the set of three like gears (only one shown here) carried by the respective holder axles. The ring gear is affixed (as by screws 101, one visible) to cup-shaped member 102, which surrounds jet housing 41 and is spaced thereupon so as to be able to rotate to and fro thereabout. Depending from the latter member, to which it is affixed, is sensing arm 103 (FIGS. 2 and 3). Control arm 104 (FIG. 3) is pinned pivotably thereto, and its utility is described below. Engagement of the ring gear and pinion gears (94*a, b, c***) is indicated by pair of concentric circular broken lines, partly concealed behind the vane holders. As is explained more fully below, diffusion of fluid propellant through the foraminous wall portion of the stuffing chamber forces the vanes outward, rotating them and their gears and thereby rotating the surrounding ring gear and the attached control arm.

Figure 5:
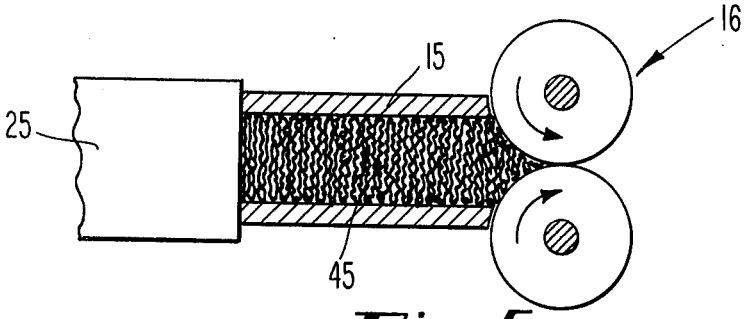
FIG. 5 is a somewhat schematized sectional view of a portion of the foregoing apparatus with a compact body of textile strand therein.

FIG. 5 shows schematically the non-foraminous wall portion of stuffing chamber 15, downstream from sensing means 25 and the foraminous wall portion surrounded thereby. This downstream part of the stuffing chamber is sectioned to reveal compact mass 45 of strand longitudinally compressed and buckled into crimped configuration. Although rolls 16 withdraw the strand from the chamber in such compressed form (and feed it simultaneously into the succeeding chamber—not shown in FIG. 5) a length of such strand released from such confinement (and preferably stabilized as described below) would be characterized in appearance by combined angular and curvilinear distortion of the component filaments from rectilinearity—similar to—but non-identical with one another, endowing the entire strand with overall uniformity in conjunction with an optimal range of crimp configuration.

It will be understood that such compact mass (45) of the compressed strand greatly hinders flow of propellant fluid downstream along the chamber axis. Accordingly, such fluid tends to diffuse radially outward through the upstream foraminous wall portion (51, see FIG. 2). Such radial diffusion is hindered somewhat by the vanes closely surrounding the chamber wall, but the more compact the strand downstream becomes the stronger the force of radial diffusion, thereby forcing the vanes apart or open. Such movement of the vanes moves the attached sensing arm (103) by turning the ring gear (100) through rotation of their pinion gears engaged therewith. Resulting movement of the attached control arm (104) is utilized in one or more ways to counteract the buildup of the compact mass and, thus, reduce the radial diffusion and concomitant arm movement, as shown in the succeeding views.

Figure 6:
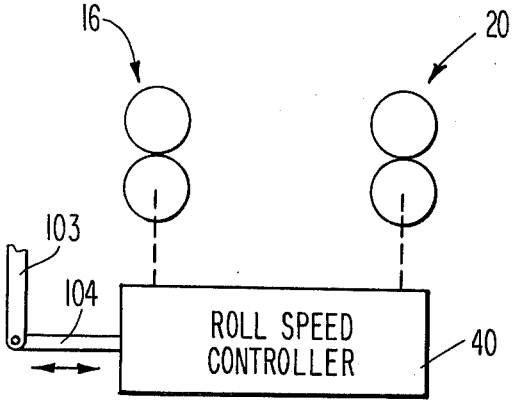
FIG. 6 is a schematic, partially block, diagram of one type of control according to the invention.

FIG. 6 shows Roll Speed Controller 40 (in block form) connected mechanically (broken lines) to respective roll pairs 16 and 20. Control arm 104 enters the controller and connects to any suitable element therein for increasing and decreasing the roll speed. The controller may comprise a conventional positive infinitely variable drive, and it is connected so that upon increased arm throw the speed of both sets of rolls increases to increase the rolls speeds (usually proportionately although different in the respective pairs). Such increase in strand removal rate, if well proportioned to the crimping rate, as may be desired by routine adjustment of the drive, will relieve the radial outflow accordingly. The negative feedback action is apparent.

Figure 7:
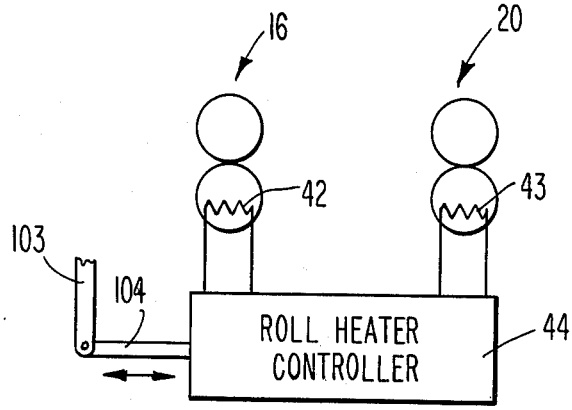
FIGS. 7 to 9 are similar schematic diagrams of other types of control thereby.

Alternatively, as shown schematically in FIG. 7, a roll in each such roll pair may have a heating element associated therewith: e.g., electrical resistance heater 42 in one of rolls 16, and similar heater 43 in one of rolls 20. Control arm 104 affects Roll Heater Controller 44 (shown in block form) to reduce the heating temperature as the radial diffusion increases so as to reduce the tendency of the strand to deform into a tightly compact mass, and to increase the heating temperature to foster deformation into a more compact mass as the radial diffusion means and the vanes move back to enclose the foraminous chamber wall.

Figure 8:
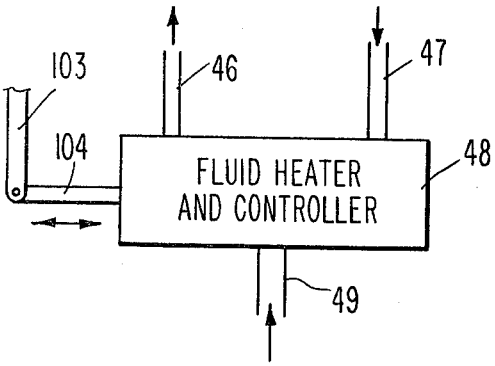

Another control method is illustrated schematically in FIG. 8, in which fluid heater and controller 48 (shown in block form) receives control arm 104 to increase the heating of treating fluid received from supply pipe 49 as radial diffusion and vane deflection increase. Tube 46 from the controller connects to bore 62 in support plate 65, and return tube 47 to the controller connects to bore 72 in support plate 75. Therebetween the hot fluid passes through jacket 71 surrounding foraminous treating chamber 77 and diffuses into and through the crimped strand therein, which has passed from entrance fitting 17, through bore 68 in support plate 65, into the chamber, from which it will exit through bore 78 in support plate 75, and exit fitting 19. Heating of the strand enables more strand to be fed into the treating chamber from the stuffing chamber, thereby relieving the necessity for radial diffusion of the propellant fluid.

Figure 9:
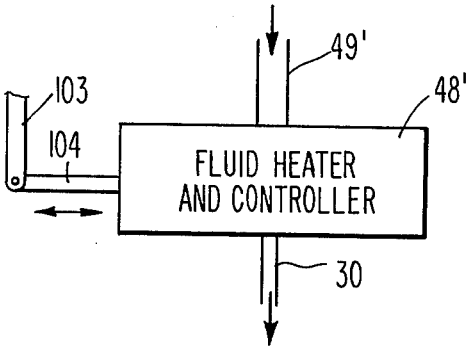

FIG. 9 shows modified fluid heater and controller 48' similarly connected to fluid inlet tube 30 for jet means 14. The interconnection to the sensing and control means is also similar to that in the preceding view. Fluid from inlet 49' is heated and has its flow regulated so that vane deflection increases the heating of the strand in the jet means by the propellant fluid.

Whichever one or more of these control methods is used, the effect is to stabilize the overall treatment of the strand to enhance desirable crimp uniformity and dephasing plus strand integrity as via interfilament entanglement. In addition, the throughput of the strand is increased by resulting increase of maximum processing speed without undesirable softening, fusion, or degradation of the strand composition. Additional advantages and benefits of the apparatus and process of this invention, as well as of strands treated thereby will become readily apparent to those persons who undertake to practice it in the light of this specification.

Additional chambers (and nip rolls) may be added, if desired, to aid the reconversion of the crimped strand from a compact mass to longitudinal form suitable for winding, and roll speed may be raised as the strand proceeds downstream to aid therein.

Notwithstanding the illustration and description of certain embodiments of the present invention, modifications may be made therein, as by adding, combining, or subdividing parts or steps, or by substituting equivalents, while maintaining all or some of the advantages and benefits of this invention, which itself is defined in the following claims.

I claim:

1. In apparatus for compressively crimping funicular textile material, including means for feeding such material together with propellant fluid into a confining region for temporary retention therein, wherein propellant fluid is permitted to diffuse laterally from an upstream portion of the temporarily confining region in which the textile material accumulates in a downstream portion thereof in crimped configuration, the improvement comprising means for sensing such lateral diffusion mounted adjacent an upstream portion of the region, and including also control means responsive and operatively connected to the sensing means for controlling a physical condition to which the textile material is subjected in the process including a plurality of vanes surrounding a portion of the region and mounted for deflection outward therefrom by positive flow of the diffusing fluid.

2. In apparatus for crimping textile material wherein funicular textile material is compressively retained temporarily at the downstream portion of a laterally confining chamber into whose upstream portion it has been injected by flow of propellant fluid, at least the upstream portion of the chamber being laterally foraminous, the improvement comprising an external multiple vane assemblage mounted for movement between a rest position for the vanes covering the foraminous chamber wall and a deflected position for the vanes spaced apart from the foraminous chamber wall by the impact of laterally diffusing propellant fluid from the interior to the exterior of the foraminous chamber wall, and including control means responsive and operatively connected to the vane assemblage for controlling a physical condition to which the textile material is subjected while in the apparatus.

3. Textile treating apparatus according to claim 2 wherein there are several like vanes equally spaced about the chamber axis.

4. Textile treating apparatus according to claim 2, wherein the vane assemblage mounting includes pivot means and also spring means interconnecting each vane and the chamber whereby each vane is spring-loaded to pivot to cover the foraminous upstream portion of the chamber wall.

5. Textile treating apparatus according to claim 4 wherein each vane mounting includes also a spur gear fixed relative to the vane and movable together with the vane relative to the chamber, and including also a ring gear concentric with the chamber and engaging all of the spur gears.

6. Textile treating apparatus according to claim 5, including also a control arm pivotally secured to the ring gear and movable together therewith.

7. In compressive crimping of funicular textile material propelled lengthwise and accompanied by flow of propellant fluid into a first laterally confined region, wherein propelled textile material accumulates temporarily as a compressed mass in a downstream portion of the region, and at least some such fluid diffuses laterally from a lengthwise portion of the region unoccupied by the compressed mass, the improvement comprising utilizing positive lateral diffusion of such fluid to control the accumulation of compressed textile material in the region by controlling the temperature of the fluid with which the textile material comes into contact, including the steps of taking up the textile material from the leading edge of the compressed mass thereof in the region, confining the textile material temporarily in a successive region for fluid treatment therein, injecting treating fluid into the latter region, and adjusting the temperature of such treating fluid to heat-treat the textile material to a greater extent the further it tended to accumulate in the first region and to heat-treat the textile material to a lesser extent the less it tended to accumulate in the first region.

* * * * *